United States Patent [19]

Monasco

[11] Patent Number: 4,832,345

[45] Date of Patent: May 23, 1989

[54] GOLF BALL TEEING APPARATUS

[75] Inventor: Raymond D. Monasco, Norman, Okla.

[73] Assignee: E-Z Drive, Inc., Oklahoma City, Okla.

[21] Appl. No.: 84,317

[22] Filed: Aug. 10, 1987

[51] Int. Cl.[4] ..... A63B 57/00

[52] U.S. Cl. ..... 273/201

[58] Field of Search ..... 273/201, 176, 182 R, 273/183 A; 124/50; 221/6, 13

[56] References Cited

U.S. PATENT DOCUMENTS

| | | | |
|---|---|---|---|
| 1,637,537 | 8/1927 | Roberts | 273/201 |
| 1,695,006 | 3/1928 | Brockhagen | 273/201 |
| 2,198,968 | 4/1940 | Jewett | 273/201 |
| 2,295,599 | 9/1942 | Mozel | 273/201 |
| 3,289,694 | 1/1967 | Turneau et al. | 273/201 |
| 3,294,402 | 12/1966 | Scott | 273/201 |
| 3,448,985 | 6/1969 | Scott | 273/201 |
| 3,966,213 | 6/1976 | Bradley | 273/201 |
| 4,017,087 | 4/1977 | Bruno | 273/201 |
| 4,126,313 | 11/1978 | Izumi | 273/35 B |
| 4,198,054 | 4/1980 | Stone | 273/201 |
| 4,355,811 | 10/1982 | Williams, Sr. | 273/201 |

*Primary Examiner*—Richard C. Pinkham
*Assistant Examiner*—T. Brown
*Attorney, Agent, or Firm*—Glen M. Burdick

[57] ABSTRACT

An improved golf teeing apparatus adapted to automatically tee a predetermined number of golf balls in time sequences selected by the golfing participant. The apparatus comprises a housing having a ball inlet opening in a side portion thereof, a housing cover assembly having a tee access opening therein, and a ball hopper connected to the housing via a ball delivery conduit such that gravitational single file ball travel is achieved through the ball delivery conduit to the ball inlet opening of the housing. A ball support assembly is disposed within the housing for receiving one ball at a time from the ball delivery conduit, and for supporting the golf ball at a selected height above the housing cover so that the golf ball can be struck by a golf club. The ball support assembly includes a vertically disposed tubular member having a ball receiving opening communicating with the ball inlet opening of the housing, and a piston member disposed within the tubular member. The piston member is operably connected to a power assembly such that the piston member is movable between a lower position, and an upper position. The piston member biases the remaining balls within the ball delivery conduit away from the ball receiving opening as the piston is moved from the lower position to the upper position.

17 Claims, 3 Drawing Sheets

GOLF BALL TEEING APPARATUS

BACKGROUND OF THE INVENTION

1. Field of the Invention

The present invention relates generally to an apparatus for teeing a golf ball in position to be hit by a golf club during the practicing of golf shots by golf participants; and more particularly, but not by way of limitation, to an apparatus adapted to automatically tee a predetermined number of golf balls in a time sequence selected by the golf participant.

2. Brief Description of the Prior Art

With the increased popularity of the game of golf, it has become common for golfers to attempt to improve their skills as to alignment, foot work and swing path of the golf club by hitting numerous golf balls at a driving range. The element of alignment can generally be achieved by visual sighting and proper body alignment relative to the target. However, alignment with the target alone will not insure that the ball, upon striking with the golf club, will be in close proximity to the target. Thus, it is essential that the participant not only be properly aligned with the target, but that the participant be able to consistently reproduce a swing path so that the club strikes the bal in the direction of its intended target.

To improve and achieve a consistent swing path of the golf club the golfer should practice by frequently hitting a large number of golf balls. When practicing with certain golf clubs, such as the wood clubs, it is desirable to position the golf ball on a tee. In such instances, it is necessary for the golfer to bend over after hitting each golf ball to reposition both the tee and another ball. This procedure is time consuming and often distracting during teaching sessions. Further, it is often difficult for elderly and handicapped persons to constantly bend over to reposition the tee and the ball. As a result, such persons do not utilize the driving range to improve their golf skills.

Various devices have been proposed by the prior art for automatically teeing golf balls. Typical of such devices are disclosed in the following U.S. patents:

| U.S. Pat. No. | Issued Date | Inventor |
|---|---|---|
| 4,198,054 | 4/15/80 | Stone |
| 4,017,087 | 4/12/77 | Bruno |
| 3,966,213 | 6/29/76 | Bradley |
| 3,448,985 | 6/10/69 | Scott |
| 2,295,599 | 9/15/42 | Mozel |
| 1,695,006 | 12/11/28 | Brockhagen |

While such prior art devices are capable of placing a golf ball in position to be hit by a golf club, many of such devices are complex mechanical structures which are subject to frequent mechanical failures, and as a result are expensive to maintain and repair.

Other prior art devices require bulky storage bins or ball hoppers which are not only unsightly in appearance, but require use of considerable ground space at the driving range. Therefore, the need has remained for a golf teeing apparatus which is economical to manufacture, durable in construction and reliable in operation. Further, such apparatus should desirably not require large surface areas to support various units of the apparatus, and should be capable of being utilized by right-handed as well as left-handed golfers. It is to such an apparatus that the present invention is directed.

SUMMARY OF THE INVENTION

The present invention provides an improved golf teeing apparatus adapted to automatically tee a predetermined number of golf balls in time sequences selected by the golfing participant. Broadly, the apparatus comprises a housing having a ball inlet opening in a side portion thereof, a housing cover having a tee access opening therein, and a ball hopper connected to the housing via a ball delivery conduit such that gravitational single file ball travel is achieved through the ball delivery conduit to the ball inlet opening of the housing. A ball support assembly is disposed within the housing for receiving one ball at a time from the ball delivery conduit, and for supporting the golf ball a selected height above the housing cover so that the golf ball can be struck by a golf club.

The ball support assembly of the golf teeing apparatus includes a vertically disposed tubular member having a ball receiving opening communicating with the ball inlet opening of the housing, and a piston member disposed within the tubular member. The piston member is movable between a lower position (wherein the piston member is retracted within the tubular member such that the tee portion of the tubular member is adapted to receive a golf ball gravitationally fed from the ball delivery conduit through the ball receiving opening of the tubular member), and an upper position (wherein the tee portion of the piston member supports the golf ball the selected height above the housing cover). The piston member, which is operably connected to a power assembly, biases the remaining balls within the ball delivery conduit away from the ball receiving opening of the tubular member as the piston is selectively cycled between the lower position and the upper position.

An object of the present invention is to provide a golf ball teeing apparatus of improved construction whereby a golf ball may be withdrawn from a ball storage assembly one at a time and automatically positioned to be driven by a golf club.

Another object of the present invention, while achieving the above-stated object, is to provide an apparatus for automatically teeing a golf ball which can be used by left-handed golfers as well as right-handed golfers.

Another object of the present invention, while achieving the above-stated objects, is t provide an apparatus for teeing golf balls automatically in a time sequence controllable by the individual golfer.

Yet another object of the present invention, while achieving the above-stated objects, is to provide an apparatus for teeing golf balls which is economical to manufacture, durable in construction, reliable in operation, and repairable with a minimum effort and downtime of the apparatus.

Other objects, advantages and features of the present invention will become clear from the following detailed description when read in conjunction with the drawings and the appended claims.

DETAILED DESCRIPTION

Figure 1:
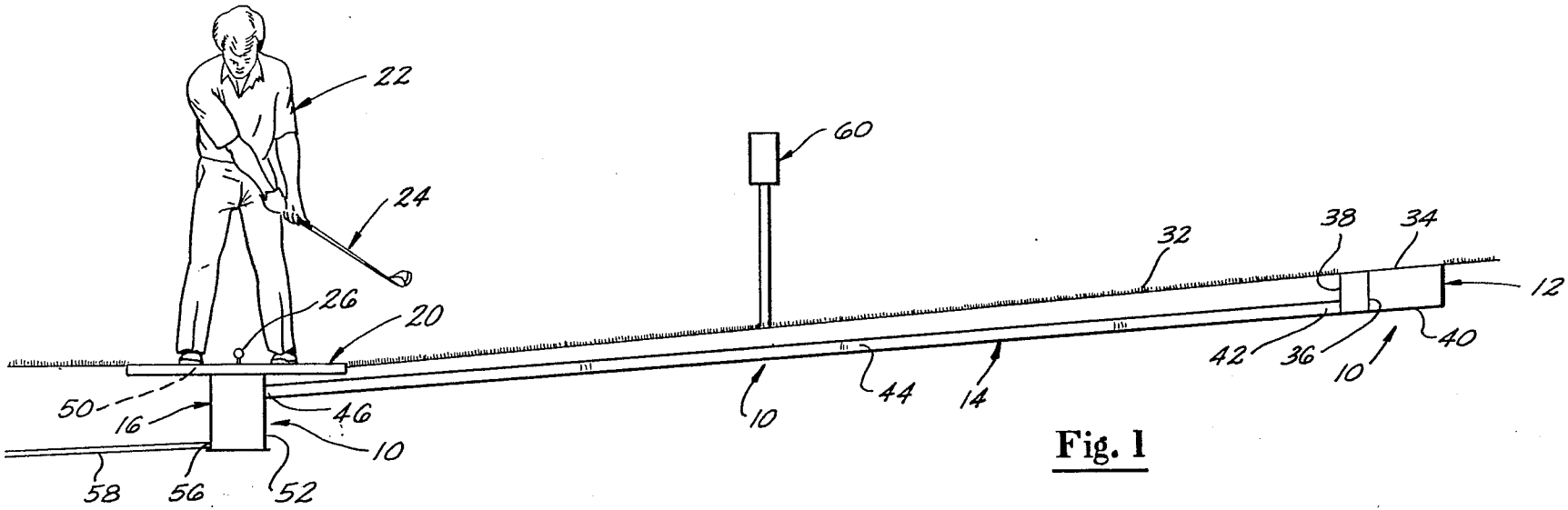
FIG. 1 is a pictorial representation of a golf participant (golfer) in a swing position for striking a golf ball supported on a golf teeing apparatus constructed in accordance with the present invention.
Figure 2:
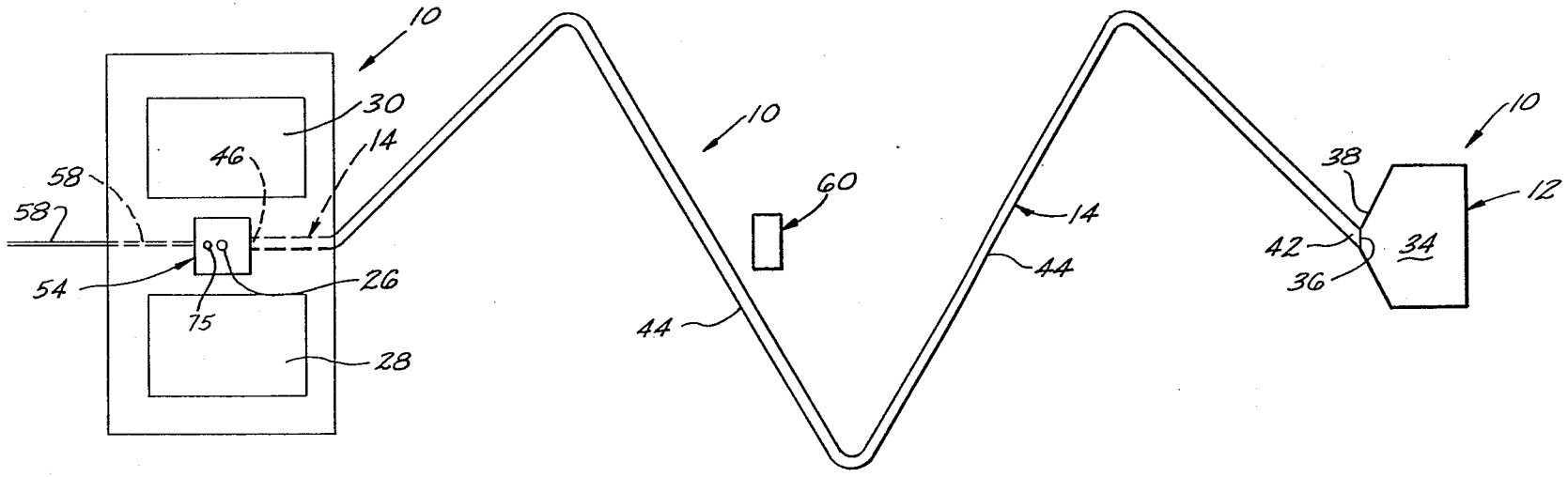
FIG. 2 is a top plan view of the golf teeing apparatus of the present invention illustrating a ball storage hopper, a ball delivery conduit, and a support platform.

Referring now to the drawings, and more particularly to FIGS. 1 and 2, a golf teeing apparatus 10 of the present invention is schematically illustrated. The golf teeing apparatus 10 comprises a hopper or ball storage bin 12, a ball delivery conduit 14, a housing 16 for a ball support assembly 18 (See FIGS. 3A and 3B), and a support platform 20. A golf participant 22 (pictorially illustrated in FIG. 1 and hereinafter referred to at times as a "golfer") is shown on the support platform 20; and the golfer 22 is swinging a golf club 24, such as a driver, to strike a golf ball 26 supported on the ball support assembly 18 of the golf teeing apparatus 10.

To insure that the golfer's feet remain in a stable position during the swing motion of the golf club 24, the support platform 20 is provided with a plurality of pads or mats 28 and 30 adapted to engage and permit penetration of the cleats of the golfer's shoes. That is, mat 28 is adapted for use by a right-handed golfer using the golf teeing apparatus 10; whereas, the mat 30 is adapted for use by a left-handed golfer using the golf teeing apparatus 10.

The hopper 12 is desirably positioned below the surface 32 of the ground substantially as shown in FIG. 1. The hopper 12, which is capable of receiving a quantity of golf balls, is characterized as having a removable cover portion 34, an outlet opening 36 in a lower portion of one end 38 thereof, and a bottom 40 having a slope in the direction of the outlet opening 36. Thus, balls positioned within the hopper 12 are directed to the outlet opening 36 thereof for single file movement through the outlet opening 36 and into the ball delivery conduit 14.

The ball delivery conduit 14 and the hopper 12 function as a ball delivery assembly for transporting golf balls single file from the hopper 12 to the ball support assembly 18. The ball delivery conduit 14 is provided with an internal diameter sufficient to permit single file travel of golf balls from the hopper 12 to the ball support assembly 18. Further, the ball delivery conduit 14 is characterized as having a first end 42, a medial portion 44 and a second end 46. The medial portion 44 of the ball delivery conduit 14 is desirably angularly disposed so as to permit a larger quantity of golf balls to be positioned and stored therein for delivery to the ball support assembly 18.

In order to provide a ball path from the hopper 12 to the housing 16, and thus to the ball support assembly 18, the first end 42 of the ball delivery conduit 14 is connected to the hopper 12 via the outlet opening 36 such that the outlet opening 36 communicates with a ball travel path defined by the ball delivery conduit 14. The second end 46 of the ball delivery conduit 14 extends through an inlet opening 48 in the housing 16 (see FIG. 3B) such that the second end 46 is disposed in a ball delivering position relative to the ball support assembly 18.

The support platform 20 is provided with a centrally disposed opening 50 (illustrated by phantom lines in FIG. 1). The opening 50 is dimensioned to permit the housing 16 to be positioned in a cavity 52 formed in the ground below the opening 50 substantially as shown. Thus, when the housing 16 is disposed in the cavity 52, the inlet opening 48 of the housing 16 is positioned below the ball outlet opening 36 of the hopper 12 so that balls in the hopper 12 and the ball delivery conduit 14 are gravitationally fed to the ball support assembly 18. Further, the cavity 52 formed in the ground for receiving the housing 16 is provided with a sufficient depth so that a removable assembly cover 54 (see FIGS. 3A and 3B) of the housing 16 is substantially level with the upper surface of the support platform 20.

In order to prevent moisture from accumulating in the housing 16, due to condensation, rain and the like, the housing 16 is provided with an outlet or vent opening 56 in a lower portion thereof. A drainage conduit 58 is connected to the housing 16 so as to communicate with the outlet opening 56. Thus, condensed moisture and water can readily be removed from the housing 16 and carried to a location remote from the housing 16 and the support platform 20.

For selectively activating the ball support assembly 18 and for controlling a predetermined quantity of golf balls to be delivered from the ball delivery conduit 14 to the ball support assembly 18, the golf teeing apparatus 10 further comprises a coin-operated assembly 60. The coin-operated assembly 60 is of conventional construction and is adapted to receive a coin or token for activating the electrical and mechanical movements of the ball support assembly 18 as will be described hereinafter. Further, the coin-operated assembly 60 includes a counter (not shown) so that when a preselected number of golf balls have been delivered to the ball support assembly 18, the ball support assembly 18 is automatically shut off so that no further balls are available to the system without the insertion of an additional coin or token into the coin-operated assembly 60. Thus, the operator of the driving range can readily control the number of golf balls available to the golfer 22 for a predetermined fee utilizing the golf teeing apparatus 10 of the present invention.

Figure 3A:
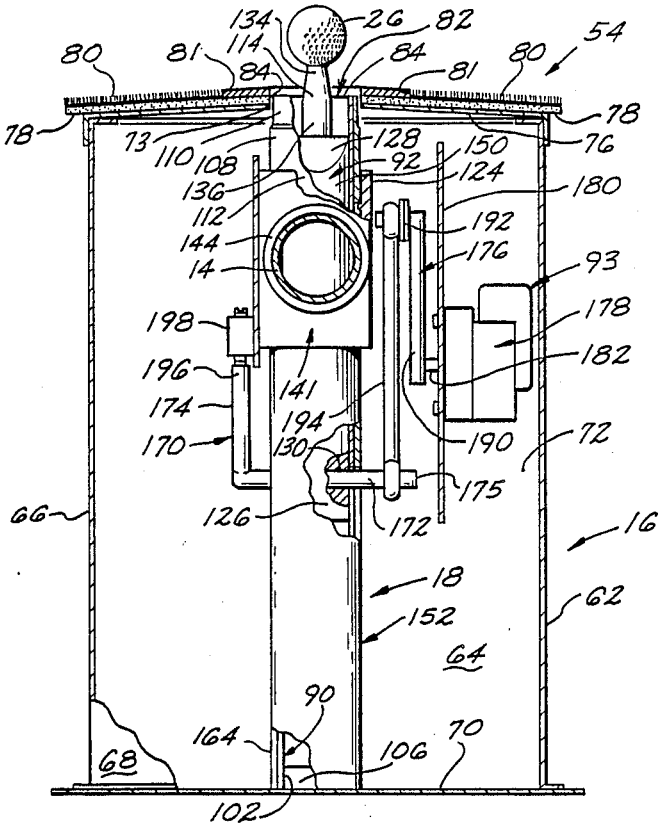
FIG. 3A is a partially cutaway, partially cross-sectional side elevational view of a housing containing a ball support assembly operably connected to a power source of the golf teeing apparatus of the present invention.
Figure 3B:
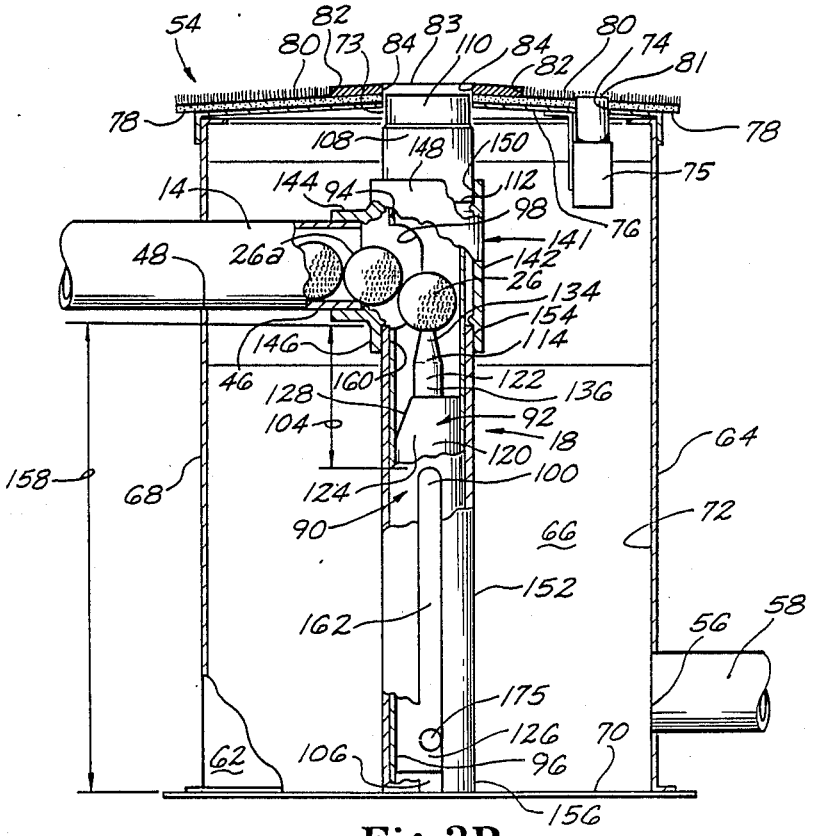
FIG. 3B is a partially cutaway, partially cross-sectional side elevational view of an adjacent side of the housing of FIG. 3A illustrating the ball support assembly of the golf teeing apparatus of the present invention.

Referring now to FIGS. 3A and 3B, the ball support assembly 18 of the golf teeing apparatus 10 is illustrated in combination with the housing 16. The housing 16 is of a box-like construction and comprises a plurality of side walls 62, 64, 66 and 68, and a bottom plate 70 which cooperate to define a cavity 72. The ball support assembly 18 is secured within the cavity 72 of the housing such that when the cover assembly 54 (which contains a tee access opening 73) is placed in position, the ball support assembly 18 can position the golf ball 26 a selected height above the cover assembly 54 via the tee access opening 73.

The cover assembly 54 is also provided with a switch receiving opening 74 adapted to receive a pressure actuated switch 75. The opening 74 is disposed a distance from the tee access opening 73 so as to provide access to the switch 75 and at the same time not interfere with the movement of the ball support assembly 18 through the tee access opening 73 as the ball support assembly 18 is selectively moved between the upper position and the lower position. As illustrated in FIG. 3A, when the ball support assembly 18 is selectively moved to the upper position, the ball support assembly 18 supports the golf ball 26 a selected height above the cover assembly 54 of the housing 16; whereas, when the ball support assembly 18 is in the lower position, as illustrated in FIG. 3B, the ball support assembly 18 is in a retracted position for receiving a single ball from the ball delivery conduit 14.

As previously stated, the housing 16 i positioned within the cavity 52 formed beneath the support platform 20 so that the cover assembly 54 is disposed substantially flushed with the upper surface of the support platform 20. To prevent damage to the golf club 24 by inadvertent striking of the cover assembly 54 of the housing 16, the cover assembly 54 comprises a cover member 76, a foam rubber elastomeric member 78 and a simulated turf member 80. The simulated turf member 80 can be fabricated of any suitable material well known in the art, such as synthetic turf, indoor-outdoor carpet and the like.

The foam rubber elastomeric member 78 is secured to the cover member 76 by any suitable adhesive material; and the cover member 76 and the foam rubber elastomeric member 78 are each provided with alignable openings therein which cooperate in defining the tee access opening 73 and the switch receiving opening 74 for the switch 75. The simulated turf member 80, on the other hand, is provided with an opening in one portion thereof which is alignable with the openings in the cover member 76 and the foam rubber elastomeric member 78 defining the switch receiving opening 74; and an enlarged, substantially square-shaped opening 81 in the center portion thereof which is disposed about the tee access opening 73. Thus, a square-shaped recessed portion is formed in the simulated turf member 80 via the opening 81 about the tee access opening 73. A second elastomeric member 82, dimensioned to correspond in size to the opening 81 defining the square-shaped recessed portion formed in the synthetic turf member 80, and having a suitable compressibility and durability factor, such as neoprene rubber, is positioned within the opening 81 formed in the synthetic turf member 80. The second elastomeric member 82 is provided with a centrally disposed bore 84 extending therethrough which is alignable with and substantially corresponds in size with the tee access opening 73 formed through the cover member 76 and the foam rubber elastomeric member 78.

The synthetic turf member 80 and the second elastomeric member 82 are secured to the foam rubber elastomeric member 78 by any suitable adhesive well known in the art. Further, it should be noted that in order to protect the golf club 24 from striking the edges of the cover member 76, the foam rubber elastomeric member 78 and the simulated turf member 80 are each provided with dimensions slightly greater than the dimensions of the cover member 76 substantially as shown in FIGS. 3A and 3B. That is, the foam rubber elastomeric member 78 and the simulated turf member 80 are slightly larger in size than the cover member 76 so as to overhang the cover member 76.

The ball support assembly 18 (which is adapted to receive golf balls one at a time from the ball delivery conduit 14 and to support one golf ball 26 at a time at a selected height above the cover assembly 54 of the housing 16) comprises a vertically disposed tubular member 90, a piston member 92 slideably retained in the tubular member 90 and a power assembly 93 operably connected to the piston member 92 for selectively cycling the piston member 92 between the upper position and the lower position. The vertically disposed tubular member 90, and thus the piston member 92, are aligned with the tee access opening 73 of the cover assembly 54.

Figure 4:
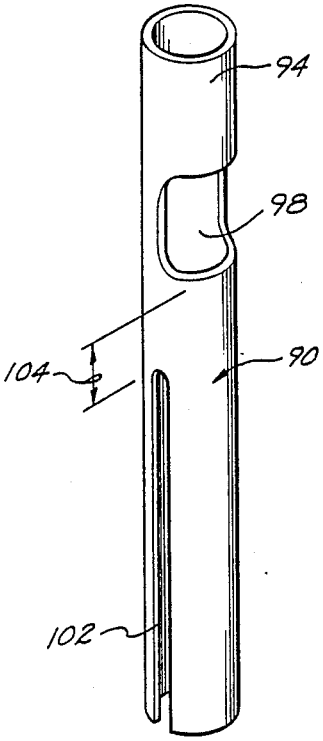
FIG. 4 is a perspective view of a tubular member of the ball support assembly of the golf teeing apparatus of the present invention, and illustrating a ball receiving opening in the tubular member.

As more clearly illustrated in FIG. 4, the tubular member 90, an elongated member, is characterized as having an upper end portion 94 and a lower end portion 96. A ball receiving slot or opening 98 is formed in the tubular member 90 such that when the tubular member 90 is positioned within the housing 16, the ball receiving slot 98 is aligned with the inlet opening 48 of the housing 16 and the second end 46 of the ball delivery conduit 14.

The tubular member 90 is further provided with a pair of aligned slots 100, 102 (see FIGS. 3B and 4) extending from the lower end portion 96 thereof and terminating a distance 104 from the ball receiving sot 98. As will be more clearly set forth hereinafter. The length of the aligned slots 100, 102 of the tubular member 90 limit the reciprocal movement of the piston member 92 in the tubular member 90.

To stabilize the tubular member 90 in the vertically disposed position within the housing 16, the lower end portion 96 is connected to and supported by a post member 106 formed in the bottom plate 70 of the housing 16. The post member 106 is aligned with the tee access opening 73 in the cover assembly 54 so that the tubular member 90 extends upwardly through the cavity 72 formed in the housing 16 in the direction of the tee access opening 73.

The tubular member 90 is provided with an overall length such that the upper end portion 94 terminates below the cover assembly 54 of the housing 16, and thus below the tee access opening 73 therein substantially as shown in FIG. 3A. In order to connect the upper end portion 94 of the tubular member 90 to the cover assembly 54, the ball support assembly 18 further comprises a resilient tubular extension member 108. The resilient tubular extension member 108 is characterized as having an upper end portion 110 and a lower end portion 112. The upper end portion 94 of the tubular member 90 is connected to the lower end portion 112 of the resilient tubular extension member 108 by positioning the upper end portion 94 of the tubular member 90 in the lower end portion 112 of the resilient tubular extension member 108. The upper end portion 110 of the resilient tubular extension member 108 is positioned within the tee access opening 73 of the cover assembly 54. Thus, the resilient tubular extension member 108 not only serves to connect the tubular member 90 to the tee access opening 73 in the cover assembly 54, but also cooperated with the tubular member 90 to define the travel path for the piston member 92, as well as the golf ball 26 supported on an upper tee portion 114 of the piston member 92, when the piston member 92 is moved to the upper position as illustrated in FIG. 3A.

Figure 5:
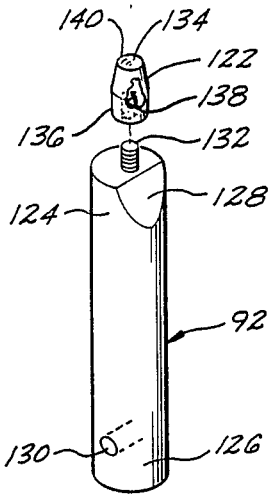
FIG. 5 is a perspective view of a piston member of the ball support assembly of the golf teeing apparatus of the present invention, and illustrating an upper tee portion on the piston member (partially cutaway) for receiving and supporting a golf ball thereon.
Figure 7:
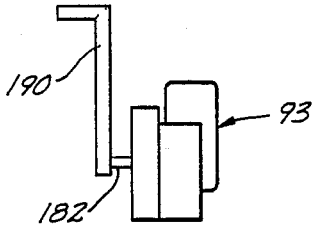
FIG. 7 is a side elevational view of a motor operably connected to a linkage assembly for selectively cycling the piston member of the ball support assembly of the golf teeing apparatus between an upper position and a lower position.

Referring now to FIGS. 3B and 5, the piston member 92 comprises a lower body portion 120 and a resilient golf ball support member 122 forming the upper tee portion 114 of the piston member 92. The lower body portion 120, an elongated, cylindrically-shaped member, is characterized as having an upper end portion 124 and a lower end portion 126. A beveled portion 128 is formed along one side of the upper end portion 124 (substantially as shown in FIG. 5) such that when the piston member 92 is positioned within the tubular member 90 the beveled portion 128 is in a facing relationship with the ball receiving slot 98 of the tubular member 90. This, as the lower body portion 120 and the resilient golf ball support tee member 122 are moved within the tubular member 90 from the lower position to the upper position, the beveled portion 128 of the piston member 92 engages an adjacently disposed golf ball 226(*a*) in the ball delivery conduit 14 such that continued upward movement of the piston member 92 biases the golf balls in the delivery conduit 14 away from the ball receiving slot 98 of the tubular member 90.

The lower body portion 120 of the piston member 92 is further provided with a bore 130 extending through a lower portion thereof, and a threaded post member 132 supported on the upper end portion 124. The threaded post member 132 is axially aligned with the central longitudinal axis of the lower body portion 120; while the bore 130, which is alignable with the slots 100, 102 of the tubular member 90, is substantially normally disposed to the central longitudinal axis of the lower body portion 120. The bore 130, and thus the slots 100, 1-02 cooperate to permit the piston member 92 to be operably connected to the power assembly 93 as will be described in detail hereinafter.

The resilient golf ball support tee member 122 forming the upper tee portion 114 of the piston member 92 is characterized as having an upper end portion 134 and an opposed lower end portion 136. The lower end portion 136 is provided with a centrally disposed threaded recess 138 adapted to threadably engage the threaded post member 132; whereas, the upper end portion 134 of the resilient golf ball support member 122 is provided with a concaved surface 140 adapted to supportingly receive and stabilize the golf ball 26 thereon.

The resilient golf ball support tee member 122 can be fabricated of any suitable material having the desired strength to support the golf ball 26, while at the same time having the required resiliency to prevent damage to the golf club 24 upon striking of the golf ball support tee member 122 with the golf club 24. Further, it should be noted that the distance that the golf ball 26 is supported above the cover assembly 54 is determined by the length or height of the resilient golf ball support tee member 122. It should also be noted (see FIG. 3A) that the length of the lower body portion 120 of the piston member 92, and the threaded post member 132 for connecting the resilient golf ball support tee member 122 thereto are such that the threaded post member 132 is disposed below the upper surface of the cover assembly 54 when the piston member 92 is in the upper position. Thus, contact between the golf club 24 and the piston member 92 or the threaded post member 132 is substantially impossible.

Referring again to FIGS. 3A and 3B, the golf ball teeing apparatus 10 further comprises a coupling assembly 141 for connecting the second end 46 of the ball delivery conduit 14 to the tubular member 90 such that communication is established between the ball delivery conduit 14 and the tubular member 90 via the ball receiving slot 98. Any suitable coupling assembly can be employed to couple the ball delivery conduit 14 to the tubular member 90 of the ball support assembly 18. However, desirable results have been obtained wherein the coupling assembly 141 is a T-coupling member 142 having a first leg member 144, a second leg member 146 and a third leg member 148, each of which openly communicates one with the other. As illustrated, the second and third leg members 146 and 148 have a common central axis, and the first leg member 144 has a central axis substantially normal to the central axis of the second and third leg members 146, 148. The T-coupling member 142 is positioned on the tubular member 90 such that the first leg member 144 openly communicates with the ball receiving slot 98, and the third leg member cooperates with tubular member 90 to form an annulus 150 therebetween. The lower end portion 112 of the resilient tubular extension member 108 is positioned within the annulus 150 to assist in forming a suitable connection between the third leg member 148 of the T-coupling member 142 with the adjacent portion of the tubular member 90, and to stabilize the resilient tubular extension member 108 thereon.

In order to strengthen and further stabilize the tubular member 90 of the ball support assembly 18, the ball support assembly 18 further comprises a tubular support member 152 adapted to receive and support the portion of the tubular member 90 disposed below the ball receiving slot 98 of the tubular member 90. Thus, the tubular support member 152 is vertically disposed within the housing 16 substantially as shown.

The tubular support member 152 is characterized as having an upper end portion 154, a lower end portion 156, and a length 158 which is approximately equal to the distance between the lower end portion 96 and the ball receiving slot 98 of the tubular member 90. The lower end portion 156 of the tubular support member 152 is secured to the bottom plate 70 of the housing 16 by the post member 106, and the upper end portion 154 thereof is disposed within an annulus 160 formed between the second leg member 146 of the T-coupling member 142 and the tubular member 90. If desired, the T-coupling member 142 ca be selected wherein the internal diameters of the first, second and third leg members 144, 146, 148 frictionally engage the second end 46 of the ball delivery conduit 14, the lower end portion 112 of the resilient tubular extension member 108, and the upper end portion 154 of the tubular support member 152, respectively; or such elements ca be connected using any suitable adhesive well known in the art.

Figure 6:
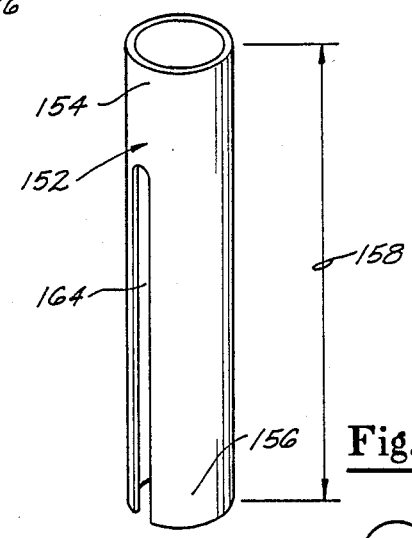
FIG. 6 is a perspective view of a tubular support member of the ball support assembly of the golf teeing apparatus of the present invention, the tubular support member adapted to receive and stabilize the tubular member of the ball support assembly.

The tubular support member 152 is further provided with a pair of aligned slots 162, 164 (see FIGS. 3B and 6) extending from the lower end portion 156 thereof and having a length substantially corresponding to the length of the slots 100, 102 of the tubular member 90. The slots 162, 164 of the tubular support member 152 are alignable with the slots 100, 102 of the tubular member 90 so as to permit the piston member 92 to be operably connected to the power assembly 93 for selective movement of the piston member 92 through the tubular member 90.

Referring now to FIG. 3A, the ball support assembly 18 further comprises a substantially L-shaped rod member 170 having a first leg 172 and a normally disposed second leg 174. The first leg 172 is positionable through the aligned slots 162, 164 of the tubular support member 152, the aligned slots 100, 102 of the tubular member 90, and the bore 130 through the body portion 120 of the piston member 92. Thus, an end 175 of the first leg member 172 extends outwardly from the tubular support member 152 for connection to a linkage assembly 176 of the power assembly 93, and the second leg 174 extends upwardly along the tubular support member 152 so as to be substantially parallel to the central longitudinal axis of the piston member 92, and thus the tubular member 90 and the tubular support member 152 substantially as shown.

As previously stated, the piston member 92 is operably connected to the power assembly 93 via the L-shaped rod member 170 and the linkage assembly 176 such that upon actuation of the power assembly by depression of the switch 75, the piston member 92 can be selectively cycled between the upper position and the lower position. The power assembly 93 comprises, in addition to the switch 75, an electric motor 178 supported within the housing 16 by a motor mount support member 180. The motor 178 is an electric motor having a rotatable shaft 182 and is connectable to a power source (not shown). The linkage assembly 176 is pivotably connected to the shaft 182 of the motor 178 and the first leg 172 of the L-shaped rod member 170 such that upon activation of the motor 178, the shaft 182 is caused to rotate, thereby selectively moving the piston 92 between the upper and lower positions via the linkage assembly 176 and the L-shaped rod member 170.

The linkage assembly 176 comprises a crank arm 190, pivotably connected at 192 to one end of a connecting rod 194; and the other end of the connecting rod 194 is pivotably connected to the outwardly extending end portion 175 of the first leg 172 of the L-shaped rod member 170. As the shaft 182 of the motor 178 turns, the crank arm 190 and the connecting rod 194 are caused to rotate 360 degrees and serve to move the body portion 120 of the piston member 92, and thus the resilient golf ball support tee member 122, from the upper position (illustrated in FIG. 3A) through the lower position (illustrated in FIG. 3B) back to the upper position. When the body portion 120 is in the lower position, that is, the resilient golf ball support tee member 122 is disposed below the ball receiving slot 98 of the tubular member 90, one of the golf balls from the ball delivery conduit 14 is directed into supporting position on the concave upper end portion 134 of the resilient golf ball support tee member 122. Further, as the body portion 122 of the piston member 92 is cycled to the upper position (as illustrated in FIG. 3A) a distal end 196 of the second leg 174 of the L-shaped rod member 170 engages a limit switch 198 which shuts off power to the motor 178. power to the motor 178 will remain shut off until such time as the golfer selectively activates the motor 178 by depressing the power switch 75.

The power switch 75 is supported within the housing 16 by a mounting bracket 200 such that the switch 75 is readily accessible through the switch receiving opening 74 in the cover assembly 54; and the limit switch 198 is supported within the housing 16 by a mounting bracket 201 so as to be aligned with and engageable with the distal end 196 of the second leg 174 of the L-shaped rod member 170.

Figure 8:
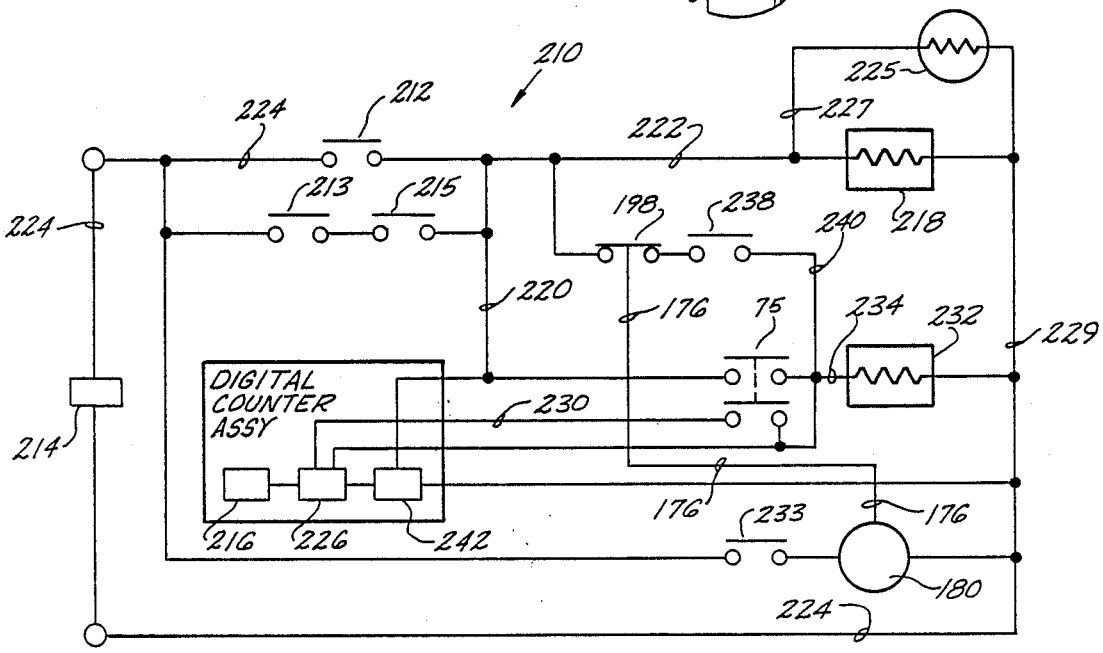
FIG. 8 is a wiring diagram of the golf teeing apparatus of FIG. 1.

Referring now to FIG. 8 the operation of the golf teeing apparatus 10 illustrated in FIG. 1 will be described with reference to a wiring diagram 210 of the apparatus 10. When a coin or token (not shown) is deposited into the coin operated assembly 60 a coin actuated switch 212 is momentarily closed, which in turn energizes relays 216 and 218, thus closing contacts 213 and 215 so that electrical current flows from a power source 214 to a digital counter 226 via lines 220 and 222, respectively, so as to complete the power on circuit represented by the line 229. A light 225 is connected to lines 222 and 229 via line 227 so as to be in parallel the power on relay 218 and provide a visual indication that the system is operational.

A microprocessor 226 in the digital counter assembly is connected to switch 75 via line 230; switch 75 is connected to a motor relay 232 via line 234; and motor relay 232 is connected to line 229. The switch 75 is activated by the golfer 22 which results in actuation of motor 178 by the energizing of the motor relay 232 and the closing of the switch 233.

The switch 198, which is connected to the motor 180 by the mechanical linkage assembly 176, is operably connected to the motor relay 232 via switch 238 and line 240 so that when power is disconnected from the motor relay 232, the motor relay 232 deactivates the motor 180. That is, the switch 198 deactivates the motor 180 after each 360 degree rotation of the linkage assembly 176. When the switch 198 engages the mechanical linkage 176 a switch 238 is opened so that the motor relay 232 is reenergized by depression of the switch 75 by the golfer. That is, each time the switch 75 is depressed the motor relay 232 is energized and provides a signal to the digital counter assembly to count down. When the digital counter 226 reaches zero, a digital counter relay 216 will open at zero count and deenergize the power on circuit by opening contacts 213 and 215. It shall be noted that the contacts 213 and 215 will be in a closed position so that the power on circuit remains in an on position as long as the digital counter relay 216 is not at zero valve.

The golf teeing apparatus 10 of the present invention is not only durable in construction and substantially maintenance free, but is also economical in operation. For example, desirable results have been obtained where the motor 178 employed to operate the ball support assembly 18 is a 110 volt electric motor operating at 7 rpm and 50 pounds of torque. Further, it is clear that the present invention is well adapted to carry out the objects and attain the ends and advantages mentioned herein as well as those inherent in the invention. While presently preferred embodiments of the invention have been described for purposes of this disclosure, numerous changes may be made which will readily suggest themselves to those skilled in the art and which are accomplished within the spirit of the invention disclosed and as defined in the appended claims.

What is claimed is:

1. A golf teeing apparatus comprising:

a housing having a ball inlet opening in a side portion thereof and having a housing cover assembly with a tee access opening therein;

ball hopper means for storing a supply of golf balls;

ball delivery means connected to the ball hopper and to the housing for providing a ball travel path from the ball hopper means to the ball inlet opening, the ball delivery mean comprising a ball delivery conduit internally sized to permit gravitational single file ball travel;

ball support means for receiving golf balls one at a time from the ball delivery means and for supporting the golf ball at a selected height above the housing cover assembly, the ball support means comprising:

a tubular member vertically disposed in the housing and substantially aligned with the tee access opening in the housing cover assembly, the tubular member having an upper end portion, a lower end portion and a ball receiving opening in communication with the ball inlet opening in the housing, the lower end portion of the tubular member secured to a bottom plate of the housing so as to laterally stabilize the tubular member, the upper end portion of the tubular member terminating a predetermined distance from the housing cover assembly;

tubular extension means cooperating with the tubular member for defining a travel path therethrough, the tubular extension means having an upper end portion and a lower end portion, the lower end portion of the tubular extension means connectable to the upper end portion of the tubular member, the upper end portion of the tubular extension means disposed substantially adjacent the cover assembly such that the travel path is aligned with the tee access opening in the cover assembly;

a piston member disposed within the tubular member and having a lower body portion dimensioned to be slideably retained within the tubular member and an upper tee portion configured to receive a single ball from the remaining balls in the ball delivery conduit, the piston member movable along the travel path between a lower position to receive a golf ball on the upper tee portion gravitationally fed from the ball delivery conduit through the ball receiving opening of the tubular member, and an upper position at which the upper tee portion extends through the tee access opening in the housing cover assembly, one portion of the lower body portion of the piston configured to bias the remaining balls within the ball delivery conduit away from the ball receiving opening as the piston is moved to the upper position; and power means operably connected to the piston member for selectively cycling the piston member between the upper position and the lower position thereof.

2. The golf teeing apparatus of claim 1 further comprising:

coupling means for connecting the tubular member of the ball support means to the ball delivery conduit such that communication is established between the ball delivery conduit and the ball receiving opening in the tubular member.

3. The golf teeing apparatus of claim 2 wherein the ball support means further comprises:

a tubular support member vertically disposed in the housing for receiving and supporting the tubular member of the ball support means, the tubular support member having a lower end portion, an upper end portion, and a length less than the distance between the lower end portion and the ball receiving opening of the tubular member, the lower end portion of the tubular support member connected to the bottom plate of the housing and the upper portion thereof connected to the coupling means.

4. The golf teeing apparatus of claim 3 wherein the housing further comprises:

a post member supported on the bottom plate of the housing so as to be axially aligned with the tee access opening in the housing cover assembly, the post member adapted to receive the lower end portions of the ball delivery conduit and the tubular support member for securing same to the bottom plate of the housing in a laterally stable position.

5. The golf teeing apparatus of claim 4 wherein the piston member of the ball support means comprises:

an elongated, cylindrically-shaped member positionable within the tubular member, the cylindrically-shaped member having a beveled portion formed along one side of an upper end portion thereof;

a threaded post member supported on the upper end portion of the cylindrically-shaped member so as to be axially aligned with the central longitudinal axis of the cylindrically-shaped member; and a resilient golf ball tee having an upper portion and an opposed lower portion, the lower portion having a threaded recess adapted to threadably engage the threaded post member, the upper end portion having a concave surface for supportingly receiving a golf ball thereon.

6. The golf teeing apparatus of claim 5 wherein the tubular member of the ball support means is provided with a pair of aligned slots extending from the lower end portion thereof and terminating a distance below the ball receiving opening therein, the tubular support member is provided with a pair of aligned slots extending from the lower end thereof so as to substantially correspond in length to the slots in the tubular member and to be aligned therewith when the tubular member is positioned within the tubular support member, and the cylindrically-shaped member of the ball support means is provided with a bore extending through a lower portion thereof, the bore being substantially normally disposed to the central longitudinal axis of the cylindrically-shaped member so as to be alignable with the slots in the tubular member and the tubular support member, and wherein the golf teeing apparatus further comprises:

a substantially L-shaped rod member having a first leg and a normally disposed second leg, the first leg positionable through the aligned slots of the tubular support member and the tubular member and the bore of the cylindrically-shaped member such that the second leg member extends upwardly along the tubular support member so as to be substantially parallel to the central longitudinal axis of the cylindrically-shaped member of the ball support means.

7. The golf teeing apparatus of claim 6 further comprising:

linkage means for pivotally connecting the first leg of the L-shaped rod member to the power means such that the first leg member and the cylindrically-shaped member of the ball support means reciprocally travel through the tubular member as the first leg member is selectively moved along the aligned slots of the tubular member and the tubular support member; and limit switch means supported within the housing for engaging the second leg of the L-shaped member when the cylindrically-shaped member is in the upper position, the limit switch means and power means cooperating such that upon activation of the power means the linkage means travels 360 degrees and cycles the cylindrically-shaped member between the upper position, the lower position for receiving a golf ball on the resilient tee member and the upper position whereupon the second leg of the L-shaped rod member engages the limit switch means and deactivates the power means.

8. The golf teeing apparatus of claim 7 further comprising:

switch means for selectively activating the power means and for initiating the cycle of movement of the cylindrically-shaped member for positioning of the golf ball on the resilient tee member thereof.

9. The golf teeing apparatus of claim 8 wherein the housing is further provided with a vent opening in one side thereof, the vent opening being positioned in a lower portion of the housing, and wherein the golf teeing apparatus further comprises:

conduit means connected to the vent opening of the housing for drainage of water therefrom.

10. The golf teeing apparatus of claim 9 further comprising:

coin-operated means operably connected to the switch means for selectively activating the switch means and for controlling a predetermined quantity of golf balls to be delivered from the ball delivery conduit to th tubular member of the ball support means for access to the golfer.

11. The golf teeing apparatus of claim 10 wherein the housing cover assembly comprises:

a housing cover; and elastomeric means secured to the cover of the housing for preventing scuffing of a golf club as the golf club strikes a golf ball supported on the golf tee, the housing cover and the elastomeric means having aligned openings therein for receiving the resilient tubular extension member.

12. The golf teeing apparatus of claim 11 further comprising:

a support pad having a substantially centrally disposed opening formed therein for receiving the housing, the pad having supporting portions on each side of the opening for accommodating both right-handed and left-handed golfers; and cover means supported by the pad for stabilizing the golfer thereon and for improving footing of the golfer during a swinging motion, said cover means having an opening therein such that the cover of the housing can be removed therefrom without damage to the cover means.

13. The golf teeing apparatus of claim 1, wherein the tubular extension means comprises a resilient tubular extension member having an upper end portion, the upper end portion thereof being disposed within the tee access opening and terminating substantially adjacent the housing cover assembly.

14. A golf ball teeing apparatus comprising:

a housing having a plurality of side walls, a bottom plate, and a cover defining a cavity therebetween, one of the side walls having a ball inlet opening in an upper portion thereof, a second of the side walls having a vent opening in a lower portion thereof, and the cover having a pair of openings therein, one of the openings being substantially centrally disposed;

ball hopper means for receiving an storing a supply of golf balls, the ball hopper means having a ball outlet opening for permitting one ball at a time to be removed therefrom, the ball hopper means positioned a distance from the housing such that the ball outlet opening is positioned a selected distance above the ball inlet opening of the housing;

a ball delivery conduit defining a travel path for single file movement of golf balls therethrough, the ball delivery conduit having a first end and a second end, the ball delivery conduit being capable of containing a plurality of golf balls therein, the first end of the ball delivery conduit connected to the housing such that the ball inlet opening of the housing openly communicates with the travel path of the ball delivery conduit, the second end of the ball delivery conduit connected to the ball hopper means such that the ball outlet opening of the ball hopper means openly communicates with the travel path of the ball delivery conduit to establish ball travel communication between the ball hopper means and the housing;

a post member supported on the bottom plate of the housing and aligned with the centrally disposed opening in the cover;

a tubular support member having an upper end portion and an opposed lower end portion, the lower end portion engagable with the post member such that the tubular support member is secured in a laterally stable position within the housing, the upper end portion of the tubular support member terminating a distance below the first opening in the side wall of the housing such that the tubular support member does not interfere with travel of a golf ball through the ball inlet opening, the tubular support member having a pair of aligned slots extending a selected distance from the lower end portion in the direction of the upper end portion;

a ball receiving tubular member having an upper end portion, an opposed lower end portion and a ball receiving slot formed therein a selected distance from the upper end portion so as to be alignable with the ball inlet opening in the housing, the ball receiving tubular member having a pair of aligned slots extending from the lower end portion and terminating a distance below the ball receiving slot, the ball receiving tubular member positionable within the tubular support member such that the lower end portion thereof is engagable with the post member and the pair of slots in the ball receiving tubular member are aligned with the pair of slots in the tubular support member, the upper end portion of the ball receiving tubular member terminating a distance below the cover of the housing;

a T-coupling member connected to the upper end of the tubular support member such that one leg portion thereof is alignable with the ball inlet opening of the ball receiving tubular member and connectable to the first conduit member extendable through the ball inlet opening of the housing, a second of the leg members being connected to the upper end of the tubular support member and a third leg member being disposed about an upper end portion of the ball receiving tubular member so as to define an annulus therebetween;

a resilient tubular extension member having an upper end portion, a lower end portion and a centrally disposed bore extensive therethrough, the lower end portion of the resilient tubular extension member positionable within the annulus formed between the third leg member of the T-coupling member and the upper end portion of the ball receiving tubular member, the upper end portion of the resilient tubular extension member being disposed within the central opening of the cover and substantially adjacent the cover;

a cylindrically-shaped piston member positionable within the ball receiving tubular member so as to be selectively vertically movable between an extended position and a retracted position, the cylindrically-shaped piston member having a beveled upper end portion, an opposed lower end portion, and a bore extending through a lower portion of the cylindrically-shaped piston member so as to be substantially normally disposed to an elongated axis of the cylindrically-shaped piston member, the piston member positioned within the ball receiving tubular member such that the beveled upper end portion is disposed in a facing relation to the ball receiving slot formed in the ball receiving tubular member;

a threaded post member supported on the upper end portion of the cylindrically-shaped piston member so as to be axially aligned with a central longitudinal axis of the cylindrically-shaped piston member;

a resilient golf ball support tee member having an upper end portion and an opposed lower end portion, the lower end portion having a threaded recess formed therein adapted to threadably engage the threaded post member, the upper end portion having a concave surface adapted to supportingly receive add stabilize a golf ball thereon;

a motor supported within the housing and having an energized mode and a deenergized mode, the motor having a shaft rotatable when the motor is in its energized mode;

a substantially L-shaped rod member having a first leg and a normally disposed second leg, the first leg disposable through the aligned slots of the tubular support member and the ball receiving tubular member and the bore of the cylindrically-shaped piston member such that the second leg extends upwardly along the tubular support member substantially parallel to the elongated axis of the tubular support member;

linkage means for connecting the first leg of the L-shaped rod member to the shaft of the motor and for selectively moving the L-shaped rod member along the vertically extending slots of the tubular support member and the ball receiving tubular member whereby the cylindrically-shaped piston member is moved between the extended position and the retracted position within the ball receiving tubular member in response to actuation of the motor;

limit switch means supported within the housing for engaging the second leg of the L-shaped member and deenergizing the motor when the L-shaped member is moved to its upper position and engages the limit switch means;

switch means supported by the cover for selectively energizing the motor and moving the cylindrically-shaped piston member to the retracted position such that the upper end portion of the golf ball support tee member is positioned below the ball receiving slot of the ball receiving tubular member and a golf ball from the ball delivery conduit can be positioned thereon prior to the cylindrically-shaped piston member being returned to the extended position wherein the golf ball is supported on the tee member a predetermined distance above the cover of the housing; and drainage conduit means connected to the vent opening of the housing for draining water and venting accumulated moisture therefrom.

15. The golf teeing apparatus of claim 14 further comprising;

elastomeric means secured to the cover of the housing for preventing scuffing of a golf club as the golf club strikes a golf ball supported on the golf ball support tee, the elastomeric means having an opening therein aligned with the bore of the resilient extension member so as to permit unrestricted travel of the golf ball support tee and the cylindrically-shaped piston member between the extended and retracted positions.

16. The golf teeing apparatus of claim 15 further comprising:

a support pad having a substantially centrally disposed opening formed therein for receiving the housing, the pad having supporting portions on each side of the opening for accommodating both right-handed and left-handed golfers; and cover means supported by the pad for stabilizing the golfer thereon and for improving the footing of the golfer during a swinging motion, said cover means having an opening therein such that the cover of the housing can be removed therefrom without damage to the cover means.

17. The golf teeing apparatus of claim 15 wherein the ball delivery conduit is angularly disposed between the housing and the ball hopper means so as to extend the overall length of the ball delivery conduit therebetween, and wherein the linkage means comprises:

a crank arm; and a connecting rod, the crank arm pivotally connected at one end to the shaft of the motor and the other end pivotally connected to one end of the connecting rod, a second end of the connecting rod pivotally connected to the first leg of the L-shaped rod member such that as the shaft of the motor turns, the crank arm and the connecting rod are caused to rotate 360 degrees and function to move the piston member between the upper and lower positions.

* * * * *